US012305496B1

(12) United States Patent
AlTammar et al.

(10) Patent No.: US 12,305,496 B1
(45) Date of Patent: May 20, 2025

(54) HYDRAULIC TREATMENT OF SUBTERRANEAN FORMATIONS USING OXIDANT, NANOPARTICLES, AND CARBON DIOXIDE

(71) Applicant: Saudi Arabian Oil Company, Dhahran (SA)

(72) Inventors: Murtadha J. AlTammar, Dhahran (SA); Hassan Sakar Alqahtani, Dammam (SA); Khalid Mohammed M. Alruwaili, Dammam (SA); Katherine Leigh Hull, Houston, TX (US); Younane N. Abousleiman, Norman, OK (US)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/644,800

(22) Filed: Apr. 24, 2024

(51) Int. Cl.
*E21B 43/267* (2006.01)
*E21B 43/16* (2006.01)

(52) U.S. Cl.
CPC ..... *E21B 43/267* (2013.01); *E21B 43/164* (2013.01)

(58) Field of Classification Search
CPC ..... E21B 43/26; E21B 43/267; E21B 43/27; E21B 43/164
See application file for complete search history.

(56) References Cited

U.S. PATENT DOCUMENTS

| | | | | |
|---|---|---|---|---|
| 11,339,321 | B2 | 5/2022 | Hull et al. | |
| 2010/0243248 | A1 | 9/2010 | Golomb et al. | |
| 2017/0066959 | A1 | 3/2017 | Hull et al. | |
| 2021/0113406 | A1 | 4/2021 | Kovacs | |
| 2021/0198558 | A1* | 7/2021 | Hull | C09K 8/845 |

FOREIGN PATENT DOCUMENTS

| | | | | |
|---|---|---|---|---|
| CA | 2247483 C | * | 1/2009 | C07C 1/00 |

OTHER PUBLICATIONS

Hull et al., "Chemomechanical effects of oxidizer-CO2 systems upon hydraulically fractured unconventional source rock," The Canadian Journal of Chemical Engineering, Jul. 2021, 100(6):1417-1426, 26 pages.
Hull et al., "Oxidative kerogen degradation: a potential approach to hydraulic fracturing in unconventionals," Ene1 1rgy & Fuels, May 2010, 33(6):4758-4766, 11 pages.
Zheng et al., "A Nanoparticle Assisted CO2 Huff-N-Puff Field Test in the Eagle Ford Shale," presented at the SPE Improved Oil Recovery Conference, held virtually, Aug. 31, 2020, 17 pages.

* cited by examiner

*Primary Examiner* — Zakiya W Bates
(74) *Attorney, Agent, or Firm* — Fish & Richardson P.C.

(57) ABSTRACT

A method of treating kerogen is provided. The method includes: generating a fracture network in a subterranean formation including kerogen by injecting a treatment fluid through a wellbore into the subterranean formation, the treatment fluid including water, an oxidant, and nanoparticles, the treatment fluid oxidizing a portion of the kerogen in the subterranean formation while generating the fracture network; and injecting carbon dioxide ($CO_2$) through the wellbore into the subterranean formation, the CO2 penetrating the subterranean formation through the facture network.

17 Claims, 5 Drawing Sheets

HYDRAULIC TREATMENT OF SUBTERRANEAN FORMATIONS USING OXIDANT, NANOPARTICLES, AND CARBON DIOXIDE

TECHNICAL FIELD

This disclosure relates to methods of hydraulic treatment of subterranean formations using oxidant, nanoparticles, and carbon dioxide ($CO_2$).

BACKGROUND

Hydraulic fracturing is the high-pressure pumping of a fracturing fluid into a rock formation to create cracks, or fractures, to stimulate the production of an oil or gas well. Fracturing is used to increase the production rate in many rock formations, and make the development of many wells economical. Further, hydraulic fracturing has enabled the production of hydrocarbons from unconventional resources such as shale gas, shale oil, and coal bed methane. However, due to its low permeability and other unique characteristics, unconventional formations such as shale formations may require specifically tailored hydraulic fracturing techniques for profitably producing hydrocarbons.

SUMMARY

This disclosure describes technologies relating to hydraulic fracturing techniques, more specifically to methods of hydraulic treatment of subterranean formations using oxidant, nanoparticles, and $CO_2$, which can improve well productivity.

DETAILED DESCRIPTION

Implementations described herein provide the methods of hydraulic fracturing, which is particularly useful as slickwater fracturing techniques to extract hydrocarbons from unconventional source rock formations such as shale formations. In general, oil and gas production from unconventional formations is faced with limited well productivity and fast decline in productivity due to its unique characteristics such as low permeability, complex geological structures, and diffused distribution of hydrocarbons. Therefore, advanced hydraulic fracturing techniques may be desired to create pathways for fluid flow and increase production rates.

The methods of hydraulic fracturing described in this disclosure exploits the synergistic effect of multiple materials, e.g., oxidant, nanoparticles, and $CO_2$, in fracturing to treat kerogen in the subterranean formations and improve well productivity. In various implementations, a slickwater containing an oxidant, e.g., sodium bromate and nanoparticles, e.g., surface-modified silicon dioxide is used as a first treatment fluid. The oxidants can help disintegrating the kerogen and creating more fractures in the formations. The nanoparticles can modify the wettability of the rock surface, thereby improving the slickwater-rock interaction. Further, following the slickwater injection, a second fluid containing $CO_2$ can be injected, which can reduce the in-situ hydrocarbon oil/condensate viscosity and enhance oil mobility. Various sequences and combinations of fluid injections can be performed as a part of the hydraulic fracturing, e.g., alternating slickwater injection and $CO_2$ injection. The methods of hydraulic fracturing in this disclosure can also be applied in slickwater refracturing. The combined use of oxidant, nanoparticles, and $CO_2$, can enhance the overall multi-staged fractured well oil/gas productivity by disintegrating the kerogen and other organic matters intertwined within the formation minerals and thus creating more permeable channels and fractures.

Figure 3:
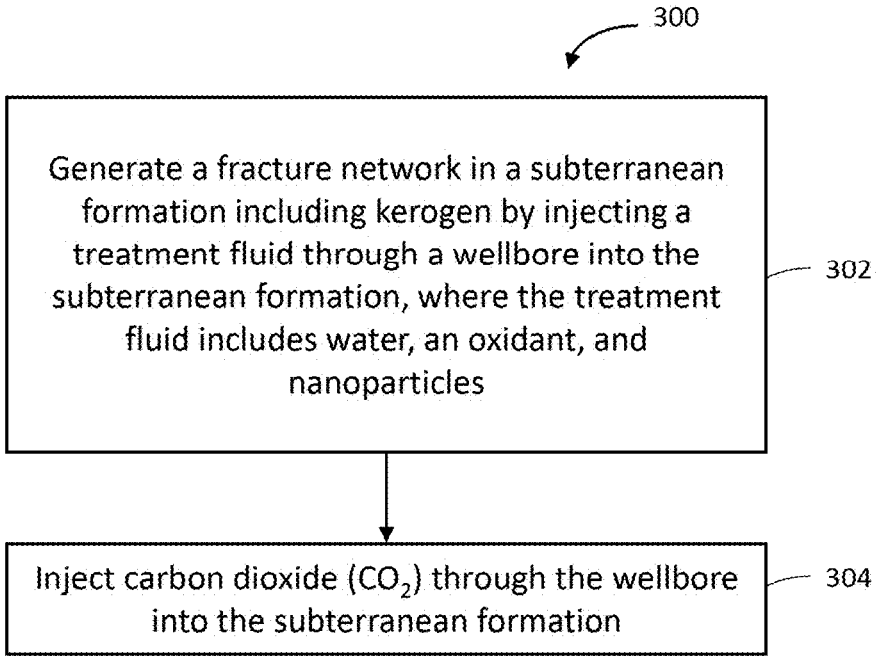
FIGS. 3-5 are process flow diagrams of processes of hydraulic treatment.
Figure 4:
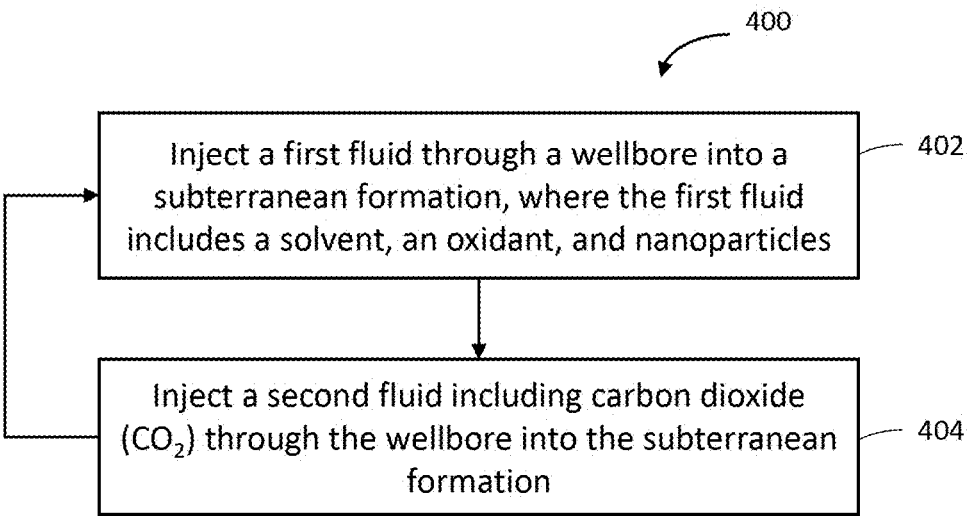
Figure 5:
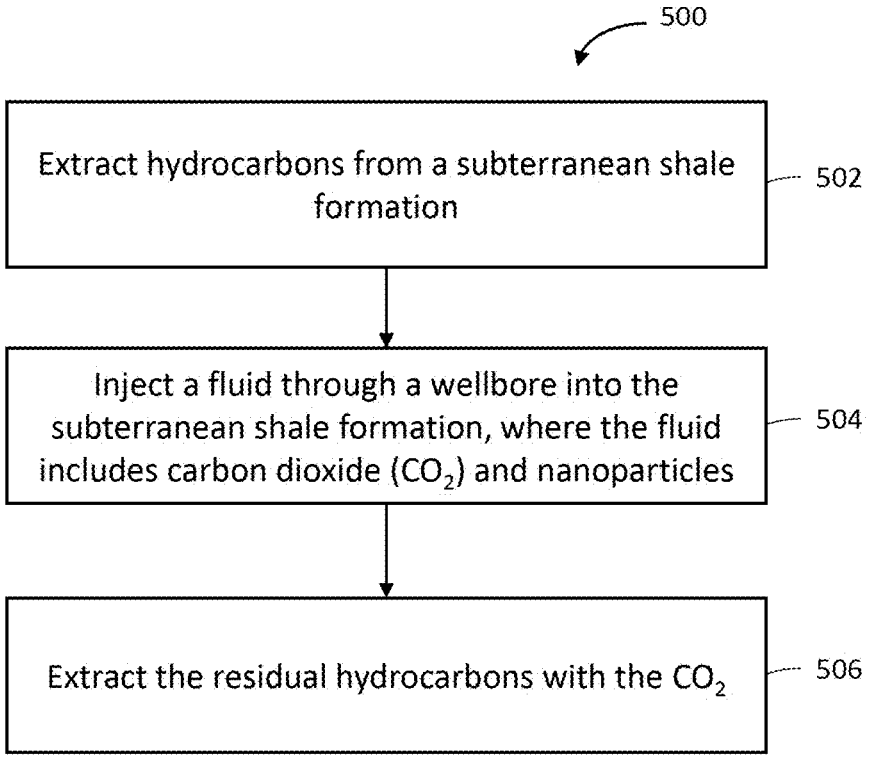

In the following, the concept of combined use of oxidant, nanoparticles, and $CO_2$ and treatment fluid compositions are first described referring to FIG. 1. An example well construction for which the methods can be applied is then described referring to FIG. 2. FIGS. 3-5 are example process flow diagrams for the methods of hydraulic fracturing.

First Treatment Fluid Composition

Figure 1:
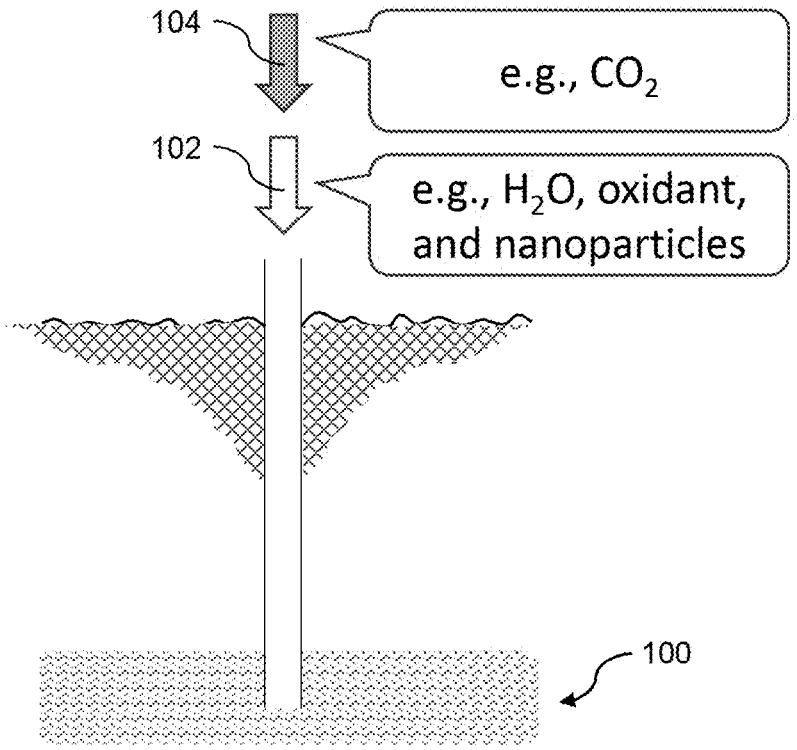
FIG. 1 is a diagram of a hydraulic treatment of a subterranean formation using oxidant, nanoparticles, and $CO_2$.

FIG. 1 is a diagram of a hydraulic treatment of a subterranean formation 100 using oxidant, nanoparticles, and $CO_2$. Treatment fluids are injected into the subterranean formation 100 to create fractures. In various implementations, a first treatment fluid containing water, an oxidant, and nanoparticles, is injected first (a first injection 102 in FIG. 1), followed by a second treatment fluid containing $CO_2$ (a second injection 104 in FIG. 1). While not specifically illustrated in FIG. 1, various sequences and combinations of fluid injections can be performed as a part of the hydraulic fracturing. For example, the $CO_2$-containing fluid can be injected first before the treatment fluid containing water, an oxidant, and nanoparticles. Further, the two fluids can be injected alternately.

In various implementations, the first treatment fluid is slickwater. Slickwater is a water-based fluid having a low viscosity relative to other hydraulic fracturing fluids that are crosslinked or linear gels. Compared to such viscous fluids such as viscoelastic surfactant-based fluid, slickwater can offer several advantages such as improved fracturing efficiency especially for unconventional formations, reduced cost, and lower environmental impact. Accordingly, the first treatment fluid can be slickwater containing the oxidant and nanoparticles. Water can be used as a base solution for the first treatment fluid. In some implementations, the base solution is a brine solution derived from seawater.

Generally, the injection of an oxidant during a fracturing process can alter organic matter such as kerogen in geological formations chemically, physically, and mechanically. As a result, the oxidant in a treatment fluid can help enhancing the porosity and permeability of organic matter in geological formations. Suitable oxidants may be selected based on their properties such as standard reduction potential (redox potential) and activation temperature. In general, the more positive the standard reduction potential, the greater the species' affinity for electrons and tendency to be reduced. Oxidants having positive standard reduction potentials can be suitable for the first treatment fluid. In some implementations, the oxidant has a standard reduction potential of great than about 0.40 V, e.g., between about 0.40 V and about 3.00 V.

The activation temperature of the oxidant corresponds to the minimum temperature of the system, e.g., a rock formation, for the oxidant to gain electrons, and thus be reduced. Accordingly, the activation temperature of an oxidant lower than the temperature of the formation of interest is desired. In low temperature formations, for example, the temperature may be up to 100° C., while in high temperature formations, it may be above 100° C., e.g., between about 100° C. and about 150° C. Therefore, depending on the target formation for fracturing, the oxidant with a suitable activation temperature range can be selected. In some implementations, the oxidant has an activation temperature between about 20° C. and about 150° C.

In various implementations, the oxidant for the first treatment fluid includes a chlorite, bromate, oxychlorine, or oxybromine. For example, the oxidant can include hypochlorite ($ClO^-$), chlorite ($ClO_2^-$ or $ClO_2$), chlorate ($ClO_3^-$), perchlorate ($ClO_4^-$), hypobromite ($BrO^-$), bromite ($BrO_2^-$ or $BrO_2$), or bromate ($BrO_3^-$). $ClO^-$ and $ClO_2$ species can be activated and effective in low temperature regime, e.g., at about 100° C. or below. On the other hand, species such as $BrO_3^-$, $CO_2^-$, $ClO_3^-$, and $ClO_4^-$ can be applicable and effective in high temperature regime, e.g., above 100° C.

In some implementations, the oxidant includes a salt of an alkali metal or alkaline earth metal. Examples include but are not limited to lithium chlorate ($LiClO_3$), sodium chlorate ($NaClO_3$), potassium chlorate ($KClO_3$), magnesium chlorate ($Mg(ClO_3)_2$), calcium chlorate ($Ca(ClO_3)_2$), strontium chlorate ($Sr(ClO_3)_2$), barium chlorate ($Ba(ClO_3)_2$), lithium bromate ($LiBrO_3$), sodium bromate ($NaBrO_3$), potassium bromate ($KBrO_3$), magnesium bromate ($Mg(BrO_3)_2$), calcium bromate ($Ca(BrO_3)_2$), strontium bromate ($Sr(BrO_3)_2$), and barium bromate ($Ba(BrO_3)_2$).

The oxidant in the first treatment fluid can refer to a compound that decomposes, at a location of interest, e.g., inside the formation, to form an oxidant that interacts with the kerogen in the subterranean formation. For example, a mixture of sodium chlorite ($NaClO_2$) and hydrochloric acid (HCl) can be used in the first treatment fluid to generate $ClO_2$ as below.

$$5NaClO_2+4\ HCl \rightarrow 5\ NaCl+4\ ClO_2+2\ H_2O$$

In one implementation, both $NaClO_2$ and sodium hypochlorite (NaOCl) can be used as below.

$$2NaClO_2+2\ HCl+NaOCl \rightarrow 2\ ClO_2+3\ NaCl+H_2O$$

In another implementation, chlorine gas ($Cl_2$) can be used to generate $ClO_2$ as below.

$$2NaClO_2+Cl_2 \rightarrow 2\ ClO_2+2\ NaCl$$

Further, $ClO_2$ can also be generated in-situ through reduction of chlorate species using a reducing agent. In various implementations, the in-situ generation of $ClO_2$ is preferred because of the safety and practical convenience of handling of precursors rather than highly reactive $ClO_2$ itself.

Other types of oxidant such as nitrate, nitrite, persulfate, perborate, percarbonate, peroxide can also be used. Examples include but are not limited to magnesium peroxide ($MgO_2$), calcium peroxide ($CaO_2$), sodium nitrate ($NaNO_3$), sodium nitrite ($NaNO_2$), sodium persulfate ($Na_2S_2O_8$), potassium persulfate ($K_2S_2O_8$), ammonium persulfate ($(NH_4)_2S_2O_8$), sodium tetraborate ($Na_2B_4O_7$), sodium percarbonate ($Na_2H_3CO_6$), hydrogen peroxide ($H_2O_2$), sodium hypochlorite (NaClO), iodate, periodate, dichromate, and permanganate. The oxidant can also be a reactive gaseous oxidant such as oxygen ($O_2$), ozone ($O_3$), nitrous oxide ($N_2O$), nitric oxide (NO), or nitrogen dioxide ($NO_2$).

The concentration of the oxidant in the first treatment fluid can range from about 1 pounds per thousand gallons (pptg) (0.12 g/L) to about 100 pptg (12.0 g/L). In some implementations, the oxidant concentration is between about 10 pptg (1.2 g/L) and about 50 pptg (6.0 g/L).

In various implementations, the nanoparticles in the first treatment fluid are effective in modifying the wettability of the rock surface and improving the fluid-rock interaction. The nanoparticles can include but are not limited to titanium oxide ($TiO_2$), zinc oxide (ZnO), aluminum oxide ($Al_2O_3$), cerium oxide ($CeO_2$), iron oxide ($Fe_2O_3$), silver oxide (AgO), magnesium oxide (MgO), nickel oxide (NiO), zirconium oxide (ZrO), or cadmium oxide (CdO). In some implementations, the nanoparticles include silica particles. The surface of the nanoparticles can be modified to improve the effect as an additive, e.g., by chemically grafting organic moieties or applying a polymeric coating.

The nanoparticles can be about 100 nm or less in diameter. In various implementations, smaller nanoparticles can be preferred so that they can enter small pore spaces during the hydraulic fracturing process. In some implementations, the nanoparticles can be between about 10 nm and about 50 nm in diameter.

In some embodiments, the first treatment fluid contains about 0.01 wt % to about 20.0 wt % nanoparticles. For example, the concentration of the nanoparticles can be between about 0.05 wt % to about 15.0 wt %, or about 0.1 wt % to about 10.0 wt %. The first treatment can also contain other additives such as friction reducers, biocides, scale inhibitors, and proppant particles.

Second Treatment Fluid Composition

The second treatment fluid contains $CO_2$. The use of $CO_2$ in a treatment fluid can also assist a fracturing process, especially in unconventional formations. For example, with its high affinity to organic matter, the $CO_2$ can help displacing and mobilizing shale gas. In some implementations, $CO_2$ molecules enters kerogen micropores, e.g., with diameters less than 2 nm, or mesopores, e.g., with diameters between about 2 nm and about 50 nm, and free up natural gas molecules trapped inside the kerogen. Accordingly, the second treatment fluid, when injected following the first treatment fluid, can enter the fracture network generated by the preceding steps of the process, and the $CO_2$ can penetrate the subterranean formation through the facture network.

In some implementations, the second treatment fluid can be injected while injecting another fluid, e.g., the first treatment fluid or other chemical additives. The additives can be used in sequence with $CO_2$ as it is being injected. The treatment chemical may be in neat form if it is a liquid or gas or alternatively the solid, liquid or gas treatment chemical could be dissolved in a solvent, e.g., water, that can be but does not have to be miscible with $CO_2$.

In one or more implementations, such additives can also be mixed as components of the second treatment fluid rather than co-injecting. For example, the second treatment fluid can contain an oxidant, nanoparticles, or both. The same types of oxidants and nanoparticles as described above for the first treatment fluid can be used for the second treatment fluid. The additives may be dissolved in $CO_2$ or distribute homogeneously in $CO_2$ as a liquid or gas. In some implementations, the additives can be pre-dissolved in a solvent that is miscible with $CO_2$ and then the $CO_2^-$ solvent mixture can be used as the second treatment fluid. However, the additives or the solvent do not have to be miscible with $CO_2$.

The concentration of the additive relative to the amount of $CO_2$ can be, for example, between about 0.00001 wt % and about 10 wt %, between about 0.0001 wt % and about 5 wt %, or between about 0.001 wt % and about 1 wt %. The concentration of pre-dissolved additives relative to its solvent could be, for example, between about 0.01 wt % and about 70 wt %, between about 0.1 wt % and about 60 wt %, or between about 1 wt % and about 50 wt %. The concentration of supplementary additives, e.g., surfactants or emulsifiers, controlled release organic, inorganic, or inorganic-organic moieties can be between about 0.001 wt % and about 5 wt %, between about 0.01 wt % and about 2 wt %, or between about 0.1 wt % and about 1 wt %.

Further, the second treatment fluid can be injected as gaseous $CO_2$ or supercritical $CO_2$. In various implementations, the supercritical state of $CO_2$ is achieved upon injection due to the high pressure, e.g., about 73 standard atmosphere (atm) or greater within the formation. For example, $CO_2$ can be stored as in liquid form at the surface and pumped into the formation at a high pumping pressure to reach the supercritical state.

Sequential Fracturing Process Using Treatment Fluid and $CO_2$

The combination of the first treatment fluid containing an oxidant and nanoparticles described above and the second treatment fluid containing $CO_2$ can be used in hydraulic fracturing in various sequences. For example, the hydraulic fracturing process can start with the injection of the first treatment fluid to generate a fracture network containing kerogen. The first treatment fluid can oxidize a portion of the kerogen in the subterranean formation while generating the fracture network. Subsequently, the second treatment fluid can be injected into the subterranean formation and to the fracture network, where the $CO_2$ of the second treatment fluid can penetrate the subterranean formation through the facture network. In some implementations, the injection of the second treatment fluid can further extend the fracture network or generate an additional fracture network.

In various implementations, the injection of the second treatment fluid can be inserted between the injections of the first treatment fluid. In some implementations, the steps of injecting the first treatment fluid and the second treatment fluid can be alternately repeated. The order of injections of the treatment fluids and number of injections at each step can be varied according to a predetermined program. Further, other types of treatment fluids can also be used in combination with the two treatment fluids.

In various implementations, the hydraulic fracturing process can include more than dozen stages, e.g., about 60 stages. For each stage, a large quantity of fluid, e.g., hundreds of thousands of gallons, can be injected to fracture the formation of interest. The program can include instructions to vary the injection parameters, e.g., injection volume, pressure, and temperature, as well as the fluid compositions, e.g., chemical additives, proppant sies, and fluid type at each stage. In some implementations, the injection amount of the first treatment fluid is between 0.00001 wt % and 10 wt % of the injection amount of $CO_2$.

In some implementations, one or more injections of the first treatment fluid or other fluids can be performed at a high-pumping rate appropriate for slickwater fracturing, e.g., between about 50 barrel per minute (bpm) (477 cubic meters per hour ($m^3$/h)) and about 150 bpm (1431 $m^3$/h). In one implementation, the pumping rate is between about 85 bpm (811 $m^3$/h) and about 95 bpm (906 $m^3$/h).

Further, when the first treatment fluid or other fluids can contain other materials such as solid proppants when injecting. In some implementations the solid proppants have a certain particle size range. For example, by using a 100 mesh that filters at about 0.149 mm, particles larger than about 0.149 mm can be collected for use. In one implementation, 40/70 mesh proppants having particle size between about 0.21 mm and about 0.42 mm can be used.

In some implementations, the second treatment fluid can be injected three times as the first, middle, and last steps in a 20-step program. Further, the specific compositions of the treatment fluids can be modified for each or some of the injection steps. For example, the hydraulic fracturing process can have hourly time windows between fracking stages, the program to control the injection steps and the specific compositions of the treatment fluids can be updated. This update can be performed based on the pumping schedule, e.g., hourly, daily, weekly, or monthly.

Accordingly, in some implementations, the hydraulic fracturing process can start with an initial injection of fluid prior to injecting the first treatment fluid. For example, $CO_2$ or a fluid containing $CO_2$ can be injected first, followed by the sequence of the injections of the first treatment fluid and second treatment fluid. Further, the methods can be applied in refracturing—a fracturing process for a well that has been already fractured and used for oil/gas production.

In other implementations, the combined use of oxidant, nanoparticles, and $CO_2$ can also be applied in methods of $CO_2$ huff-n-puff treatment. The $CO_2$ huff-n-puff is an enhanced oil recovery (EOR) technique to improve hydrocarbon production from a well that is already placed in use for a period of time, e.g., one or two years. In the $CO_2$ huff-n-puff treatment, $CO_2$ is cyclically injected in the well, e.g., a shale well, to mobilize the hydrocarbon resources remaining within the formation. While performing cycles of $CO_2$ injection and well shut-in, a fluid containing an oxidant, nanoparticles, or both can be injected as an additional step or co-injected with the $CO_2$ injection.

Well Construction

Figure 2:
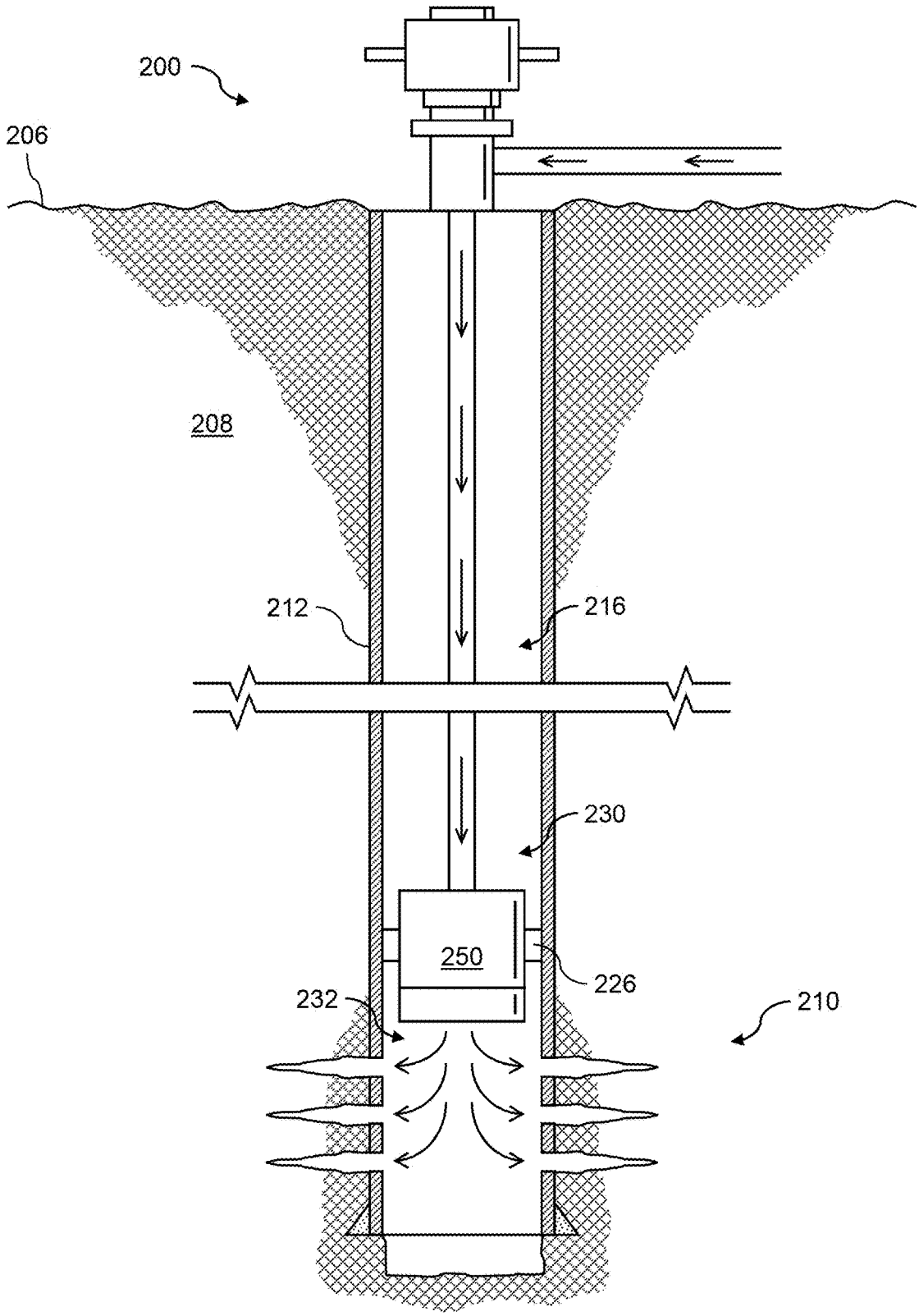
FIG. 2 is a diagram of a well for hydrocarbon production.

FIG. 2 illustrates a well 200 constructed in accordance with various implementation. The well 200 extends from a surface 206 through the Earth 208 to a subterranean zone of interest 210. The well 200 enables access to the subterranean zone of interest 210 to allow extraction of fluids to the surface 206 and additionally or alternatively allows fluids to be placed in the Earth 208. In some implementations, the subterranean zone of interest 210 is a formation within the Earth 108 defining a reservoir, but in other instances, it can be multiple formations or a portion of a formation. The subterranean zone of interest 210 can include, for example, a formation, a portion of a formation, or multiple formations in a hydrocarbon-bearing reservoir from which recovery operations can be practiced to recover trapped hydrocarbons. The subterranean zone of interest 210 includes an underground formation of naturally fractured or porous rock containing hydrocarbons, e.g., oil and natural gas. In some implementations, the well can intersect other types of formations, including reservoirs that are not naturally fractured. For simplicity's sake, the well 200 is shown in FIG. 2 as a vertical well, but in other instances, the well 200 can be a deviated well with a wellbore deviated from vertical, e.g., horizontal or slanted. Further, the well 200 can include multiple bores forming a multilateral well, e.g., a well having multiple lateral wells branching off another well or wells.

In various implementations, the subterranean zone of interest 210 is an unconventional formation such as shale formations, e.g., shale oil and shale gas formations, tight sandstone formations, coalbed methane reservoirs, and hydrate-bearing sediments. The unconventional formations can be characterized by, for example, its low permeability, complex geological structures, and diffused distribution of hydrocarbons.

In some implementations, the well 200 is a gas well that is used in producing hydrocarbon gas from the subterranean zones of interest 210 to the surface 206. While termed a "gas well," the well 200 need not produce only dry gas, and may incidentally or in much smaller quantities, produce liquid including oil, water, or both. In some implementations, the well 200 is an oil well that is used in producing hydrocarbon liquid from the subterranean zones of interest 210 to the surface 206. While termed an "oil well," the well not need produce only hydrocarbon liquid, and may incidentally or in much smaller quantities, produce gas, water, or both. In some implementations, the production from the well 200 can be multiphase in any ratio. In some implementations, the production from the well 200 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth 208.

The wellbore of the well 200 is typically, although not necessarily, cylindrical. All or a portion of the wellbore is lined with a tubing, such as casing 212. The casing 212 connects with a wellhead at the surface 206 and extends downhole into the wellbore. The casing 212 operates to isolate the bore of the well 200, defined in the cased portion of the well 200 by an inner bore 216 of the casing 212, from the surrounding Earth 208. The casing 212 can be formed of a single continuous tubing or multiple lengths of tubing joined, e.g., threadedly, end-to-end. In FIG. 2, the casing 212 is perforated in the subterranean zone of interest 210 to allow fluid communication between the subterranean zone of interest 210 and the inner bore 216 of the casing 212. In some implementations, the casing 212 is omitted or ceases in the region of the subterranean zone of interest 210. This portion of the well 200 without casing is often referred to as "open hole."

The wellhead defines an attachment point for other equipment to be attached to the well 200. For example, FIG. 2 shows well 200 being produced with a Christmas tree attached to the wellhead. The Christmas tree includes valves used to regulate flow into or out of the well 200. The well 200 also includes a system 250 residing in the wellbore, for example, at a depth that is nearer to the subterranean zone of interest 210 than the surface 206. The system 250, being of a type configured in size and robust construction for installation within the well 200, can include any type of rotating equipment that can assist production of fluids to the surface 206 and out of the well 200 by creating an additional pressure differential within the well 200. For example, the system 250 can include a pump, compressor, blower, or multi-phase fluid flow aid.

Additionally, the construction of the components of the system 250 are configured to withstand the impacts, scraping, and other physical challenges the system 250 will encounter while being passed hundreds of feet/meters or even multiple miles/kilometers into and out of the well 200. For example, the system 250 can be disposed in the well 200 at a depth of up to about 20,000 feet (about 6,096 m). Beyond just a rugged exterior, this encompasses having certain portions of any electronics being ruggedized to be shock resistant and remain fluid tight during such physical challenges and during operation. Additionally, the system 250 is configured to withstand and operate for extended periods of time, e.g., multiple weeks, months or years, at the pressures and temperatures experienced in the well 200, which temperatures can exceed 400 degrees Fahrenheit (° F.)/205 degrees Celsius (° C.) and pressures over 2,000 pounds per square inch gauge (psig), or about 13789.5 kiloPascal (kPa), and while submerged in the well fluids, e.g., gas, water, or oil. Finally, the system 250 can be configured to interface with one or more of the common deployment systems, such as jointed tubing, a sucker rod, coiled tubing that is a continuous, unbroken and flexible tubing formed as a single piece of material, or wireline with an electrical conductor that is a monofilament or multifilament wire rope with one or more electrical conductors, sometimes called e-line, and thus have a corresponding connector, e.g., a jointed tubing connector, coiled tubing connector, or wireline connector.

A seal system 226 integrated or provided separately with a downhole system, as shown with the system 250, divides the well 200 into an uphole zone 230 above the seal system 226 and a downhole zone 232 below the seal system 226. FIG. 2 shows the system 250 positioned in the open volume of the inner bore 216 of the casing 212, and connected to a production string of tubing (also referred as production tubing 228) in the well 200. The wall of the well 200 includes the interior wall of the casing 212 in portions of the wellbore having the casing 212 and includes the open hole wellbore wall in uncased portions of the well 200. Thus, the seal system 226 is configured to seal against the wall of the wellbore, for example, against the interior wall of the casing 212 in the cased portions of the well 200 or against the interior wall of the wellbore in the uncased, open hole portions of the well 200. In certain instances, the seal system 226 can form a gas- and liquid-tight seal at the pressure differential the system 250 creates in the well 200. For example, the seal system 226 can be configured to at least partially seal against an interior wall of the wellbore to separate, either completely or substantially, a pressure in the well 200 downhole of the seal system 226 from a pressure in the well 200 uphole of the seal system 226. Although not shown in FIG. 2, additional components, such as a surface compressor, can be used in conjunction with the system 250 to boost pressure in the well 200.

In some implementations, the system 250 can be implemented to alter characteristics of a wellbore by a mechanical intervention at the source. Alternatively, or in addition to any of the other implementations described in this specification, the system 250 can be implemented as a high flow, low pressure rotary device for gas flow in sub-atmospheric wells. Alternatively, or in addition to any of the other implementations described in this specification, the system 250 can be implemented in a direct well-casing deployment for production through the wellbore. Other implementations of the system 250 as a pump, compressor, or multiphase combination of these can be utilized in the well bore to effect increased well production.

The system 250 locally alters the pressure, temperature, flow rate conditions, or a combination of these of the fluid in the well 200 proximate the system 250. In certain instances, the alteration performed by the system 250 can optimize or help in optimizing fluid flow through the well 200. As described previously, the system 250 creates a pressure differential within the well 200, for example, particularly within the locale in which the system 250 resides. In some instances, a pressure at the base of the well 200 is a low pressure, e.g., sub-atmospheric; so unassisted fluid flow in the wellbore can be slow or stagnant. In these and other instances, the system 250 introduced to the well 200 adjacent the perforations can reduce the pressure in the well 200 near the perforations to induce greater fluid flow from the subterranean zone of interest 210, increase a temperature of the fluid entering the system 250 to reduce condensation from limiting production, increase a pressure in the well 200 uphole of the system 250 to increase fluid flow to the surface 206, or a combination of these.

The system 250 moves the fluid at a first pressure downhole of the system 250 to a second, higher pressure uphole of the system 250. The system 250 can operate at and maintain a pressure ratio across the system 250 between the second, higher uphole pressure and the first, downhole pressure in the wellbore. The pressure ratio of the second pressure to the first pressure can also vary, for example, based on an operating speed of the system 250.

The system 250 can operate in a variety of downhole conditions of the well 200. For example, the initial pressure within the well 200 can vary based on the type of well, depth of the well 200, and production flow from the perforations into the well 200. In some examples, the pressure in the well 200 proximate a bottomhole location is sub-atmospheric, where the pressure in the well 200 is at or below about 14.7 pounds per square inch absolute (psia), or about 101.3 kPa. The system 250 can operate in sub-atmospheric well pressures, for example, at well pressure between 2 psia (13.8 kPa) and 14.7 psia (101.3 kPa). In some examples, the pressure in the well 200 proximate a bottomhole location is much higher than atmospheric, where the pressure in the well 200 is above about 14.7 psia, or about 101.3 kPa. The system 250 can operate in above atmospheric well pressures, for example, at well pressure between 14.7 psia (101.3 kPa) and 5,000 psia (34,474 kPa).

FIGS. 3-5 are example process flow diagrams of processes of hydraulic fracturing. In FIG. 3, a process 300 according to an implementation starts with injecting 302 a treatment fluid through a wellbore into a subterranean formation comprising kerogen, where the treatment fluid includes water, an oxidant, and nanoparticles, the treatment fluid oxidizes a portion of the kerogen in the subterranean formation, and the subterranean formation is hydraulically fractured. Subsequently, carbon dioxide ($CO_2$) is injected 304 through the wellbore into the subterranean formation.

In FIG. 4, another process 400 according to another implementation starts with injecting 402 a first fluid through a wellbore into a subterranean formation, where the first fluid includes a solvent, an oxidant and nanoparticles, followed by injecting 404 a second fluid through the wellbore into the subterranean formation, where the second fluid includes carbon dioxide ($CO_2$). Subsequently, the process 400 proceeds to alternately repeating the steps of injecting the first fluid and the second fluid.

In FIG. 5, yet another process 500 according to another implementation starts with extracting 502 hydrocarbons from a subterranean shale formation. After the extracting, a fluid is injected 504 through a wellbore into the subterranean shale formation, where the fluid includes carbon dioxide ($CO_2$) and nanoparticles, and the $CO_2$ reacting with residual hydrocarbons in the subterranean shale formation. Subsequently, the residual hydrocarbons is extracted 506 with the $CO_2$.

Implementations

An implementation described herein provides a method of treating kerogen, where the method includes: generating a fracture network in a subterranean formation including kerogen by injecting a treatment fluid through a wellbore into the subterranean formation, the treatment fluid including water, an oxidant, and nanoparticles, the treatment fluid oxidizing a portion of the kerogen in the subterranean formation while generating the fracture network; and injecting carbon dioxide ($CO_2$) through the wellbore into the subterranean formation, the $CO_2$ penetrating the subterranean formation through the facture network.

In an aspect, combinable with any other aspect, the method further includes, prior to generating the fracture network, generating an initial fracture network in the subterranean formation, where the treatment fluid enters the initial fracture network, and where the fracture network generated by injecting the treatment fluid is an extended fracture network of the initial fracture network.

In an aspect, generating the initial fracture network includes injecting the $CO_2$ into the subterranean formation.

In an aspect, combinable with any other aspect, injecting the $CO_2$ includes generating an additional fracture network in the subterranean formation.

In an aspect, combinable with any other aspect, the method further includes alternately repeating the steps of injecting the treatment fluid and injecting the $CO_2$, where each injection step generates an additional fracture network.

In an aspect, combinable with any other aspect, the method further includes, while injecting the $CO_2$, injecting the oxidant and the nanoparticles.

In an aspect, combinable with any other aspect, the injected $CO_2$ is at a supercritical state.

In an aspect, combinable with any other aspect, the treatment fluid and the $CO_2$ are injected simultaneously.

In an aspect, combinable with any other aspect, the oxidant includes a chlorite or bromate.

In an aspect, combinable with any other aspect, the oxidant includes a salt of an alkali metal or alkaline earth metal.

In an aspect, combinable with any other aspect, the oxidant includes a persulfate, perborate, percarbonate, peroxide, $O_2$, $O_3$, $N_2O$, NO, or $NO_2$.

In an aspect, combinable with any other aspect, the nanoparticles include silicon oxide ($SiO_2$), titanium oxide ($TiO_2$), zinc oxide (ZnO), aluminum oxide ($Al_2O_3$), cerium oxide ($CeO_2$), iron oxide ($Fe_2O_3$), silver oxide (AgO), magnesium oxide (MgO), nickel oxide (NiO), zirconium oxide (ZrO), cadmium oxide (CdO).

An implementation described herein provides a method of hydraulic fracturing, where the method includes: injecting a first fluid through a wellbore into a subterranean formation, the first fluid including a solvent, an oxidant and nanoparticles, the injected first fluid oxidizing a portion of the subterranean formation and generating a fracture network; injecting a second fluid through the wellbore into the subterranean formation, the second fluid including carbon dioxide ($CO_2$), the $CO_2$ penetrating the subterranean formation through the facture network and dissolving another portion of the subterranean formation; and alternately repeating the steps of injecting the first fluid and the second fluid, the repeating generating an additional fracture network.

In an aspect, combinable with any other aspect, the method further includes injecting the first fluid, the second fluid, or another fluid between two steps among the steps of injecting while alternately repeating the steps of injecting the first fluid and the second fluid.

In an aspect, combinable with any other aspect, the method further includes, while injecting the second fluid, injecting another fluid including the oxidant and the nanoparticles.

In an aspect, the solvent includes a brine solution derived from seawater, wherein the oxidant includes sodium bromate or sodium chlorite, and wherein the nanoparticles are silica nanoparticles.

In an aspect, combinable with any other aspect, the concentration of the oxidant in the first fluid is between 1 pounds per thousand gallons (pptg) (0.12 g/L) to 100 pptg (12.0 g/L).

An implementation described herein provides a method of treating a shale formation, where the method includes: extracting hydrocarbons from a subterranean shale formation; after the extracting, injecting a fluid through a wellbore into the subterranean shale formation, the fluid including carbon dioxide ($CO_2$) and nanoparticles, the $CO_2$ reacting with residual hydrocarbons in the subterranean shale formation; and extracting the residual hydrocarbons with the $CO_2$ from the subterranean shale formation.

In an aspect, combinable with any other aspect, the fluid includes an oxidant.

In an aspect, combinable with any other aspect, the method further includes cyclically repeating the steps of injecting the fluid, reacting the $CO_2$, and extracting the residual hydrocarbons.

While this disclosure has been described with reference to illustrative implementations, this description is not intended to be construed in a limiting sense. Various modifications and combinations of the illustrative implementations, as well as other implementations, will be apparent to persons skilled in the art upon reference to the description. It is therefore intended that the appended claims encompass any such modifications or implementations.

What is claimed is:

1. A method of treating kerogen, the method comprising:

generating a fracture network in a subterranean formation comprising kerogen by injecting a first treatment fluid through a wellbore into the subterranean formation, the first treatment fluid comprising water, an oxidant, and nanoparticles, the first treatment fluid oxidizing a portion of the kerogen in the subterranean formation while generating the fracture network;

injecting a second treatment fluid comprising carbon dioxide ($CO_2$) through the wellbore into the subterranean formation, the $CO_2$ penetrating the subterranean formation through the facture network; and alternately repeating the step of injecting the first treatment fluid and the step of injecting the second treatment fluid, wherein each injection step generates an additional fracture network.

2. The method of claim 1, further comprising, prior to generating the fracture network, generating an initial fracture network in the subterranean formation, wherein the treatment fluid enters the initial fracture network, and wherein the fracture network generated by injecting the treatment fluid is an extended fracture network of the initial fracture network.

3. The method of claim 2, wherein generating the initial fracture network comprises injecting the $CO_2$ into the subterranean formation.

4. The method of claim 3, wherein the method comprises more than a dozen stages of injections, and at least the last stage of injection is performed using the second treatment fluid.

5. The method of claim 1, wherein injecting the second treatment fluid comprises generating an additional fracture network in the subterranean formation.

6. The method of claim 1, further comprising, while injecting the second treatment fluid, injecting the oxidant and the nanoparticles.

7. The method of claim 1, wherein the injected second treatment fluid is at a supercritical state.

8. The method of claim 1, wherein the first treatment fluid and the second treatment fluid are injected simultaneously.

9. The method of claim 1, wherein the oxidant comprises a chlorite or bromate.

10. The method of claim 1, wherein the oxidant comprises a salt of an alkali metal or alkaline earth metal.

11. The method of claim 1, wherein the oxidant comprises a persulfate, perborate, percarbonate, peroxide, $O_2$, $O_3$, $N_2O$, NO, or $NO_2$.

12. The method of claim 1, wherein the nanoparticles comprise silicon oxide ($SiO_2$), titanium oxide ($TiO_2$), zinc oxide (ZnO), aluminum oxide ($Al_2O_3$), cerium oxide ($CeO_2$), iron oxide ($Fe_2O_3$), silver oxide (AgO), magnesium oxide (MgO), nickel oxide (NiO), zirconium oxide (ZrO), cadmium oxide (CdO).

13. A method of hydraulic fracturing, the method comprising:

generating an initial fracture network in a subterranean formation by injecting a $CO_2$ through a wellbore into the subterranean formation, injecting a first fluid through the wellbore into the subterranean formation, the first fluid comprising a solvent, an oxidant and nanoparticles, the injected first fluid oxidizing a portion of the subterranean formation and extending the initial fracture network;

injecting a second fluid through the wellbore into the subterranean formation, the second fluid comprising carbon dioxide ($CO_2$), the $CO_2$ penetrating the subterranean formation through the extended facture network and dissolving another portion of the subterranean formation; and alternately repeating the steps of injecting the first fluid and the second fluid, the repeating generating an additional fracture network.

14. The method of claim 13, further comprising injecting the first fluid, the second fluid, or another fluid between two steps among the steps of injecting while alternately repeating the steps of injecting the first fluid and the second fluid.

15. The method of claim 13, further comprising, while injecting the second fluid, injecting another fluid comprising the oxidant and the nanoparticles.

16. The method of claim 15, wherein the solvent comprises a brine solution derived from seawater, wherein the oxidant comprises sodium bromate or sodium chlorite, and wherein the nanoparticles are silica nanoparticles.

17. The method of claim 13, wherein the concentration of the oxidant in the first fluid is between 1 pounds per thousand gallons (pptg) (0.12 g/L) to 100 pptg (12.0 g/L).

* * * * *